US012000168B2

(12) United States Patent
Wilschefski

(10) Patent No.: US 12,000,168 B2
(45) Date of Patent: Jun. 4, 2024

(54) SIDE LOAD PICKET DRIVER

(71) Applicant: Dallis Wilschefski, Bees Creek (AU)

(72) Inventor: Dallis Wilschefski, Bees Creek (AU)

( * ) Notice: Subject to any disclaimer, the term of this patent is extended or adjusted under 35 U.S.C. 154(b) by 0 days.

(21) Appl. No.: 17/748,717

(22) Filed: May 19, 2022

(65) Prior Publication Data

US 2022/0372786 A1 Nov. 24, 2022

(30) Foreign Application Priority Data

May 21, 2021 (AU) ..... 2021203278

(51) Int. Cl.
*E04H 17/26* (2006.01)

(52) U.S. Cl.
CPC ..... *E04H 17/263* (2013.01)

(58) Field of Classification Search
CPC ..... E04H 17/263; B65D 1/16
USPC ..... 173/1
See application file for complete search history.

(56) References Cited

U.S. PATENT DOCUMENTS 3,115,199 A * 12/1963 Linabery ..... E04H 17/263 173/126
8,276,683 B1 * 10/2012 Roy ..... B25D 1/16 173/132
10,364,590 B1 * 7/2019 Johnston ..... B25D 1/16
2004/0026095 A1 * 2/2004 Kleinert ..... E04H 17/263 173/90
2009/0152783 A1 * 6/2009 Sigler ..... E04H 17/26 269/287
2012/0145425 A1 * 6/2012 Page ..... E04H 17/265 254/133 R
2017/0058559 A1 * 3/2017 Martin ..... E04H 17/263
2019/0119948 A1 * 4/2019 Dishman ..... E04H 17/263
2022/0048175 A1 * 2/2022 Varnum ..... B25D 1/16
2022/0372786 A1 * 11/2022 Wilschefski ..... E04H 17/263
2023/0101508 A1 * 3/2023 Nice ..... E04H 17/265 254/28

FOREIGN PATENT DOCUMENTS

AU 2003100824 A4 * 11/2003
AU 2021203278 A1 * 12/2022 ..... E04H 17/263

OTHER PUBLICATIONS

Service—definition by Merriam Webster, retrieved from URL https://www.merriam-webster.com/dictionary/service on Jul. 10, 2023 (Year: 2023).*
Star Pickets—Australian Style Y Pickets, retrieved from URL https://www.starpickets.com/starpickets/y-post.html on Jul. 10, 2023 (Year: 2023).*

* cited by examiner

*Primary Examiner* — Valentin Neacsu
(74) *Attorney, Agent, or Firm* — Larry E. Henneman, Jr.; Henneman & Associates, PLC

(57) ABSTRACT

The side load picket driver is loaded from the side instead of from the bottom. The side load star picket driver is closed at the top end and open at the bottom end and has a slot down the full-length on one side of the star picket driver so that the star picket can be loaded from the side instead of the open end. There are two handles, welded to each side of the star picket driver for the operator to grip the driver and pound the star picket into the ground.

20 Claims, 7 Drawing Sheets

SECTION VIEW

FRONT VIEW

SCALE 1 : 5 @ A4

BACK VIEW

SCALE 1 : 5 @ A4

TOP VIEW

SCALE 1:1 @ A4

BOTTOM VIEW

SCALE 1 : 2 @ A4

RIGHT VIEW
SCALE 1 : 5 @ A4

LEFT VIEW

SCALE 1 : 5 @ A4

SECTION VIEW
SCALE 1 : 100 A4

SIDE LOAD PICKET DRIVER

RELATED APPLICATIONS

This application claims the benefit of foreign priority to Australian Application No. 2021203278, filed on May 21, 2021 by the same inventor, which is incorporated by reference herein in its entirety.

BACKGROUND

Field of the Invention

This invention relates to driving posts into the ground. More particularly, the invention relates primarily to driving a star picket into the ground. The device can be used for wooden pickets as well but its primary use is for star pickets. The use is more particularly designed for fencing applications where wire fences are required and in particular on cattle stations or farms or other areas where livestock needs to be contained but it is also useful for building and construction applications where temporary fencing is required for other reasons.

Thousands of star pickets are used in the vegetable garden business in the construction of trellises.

Description of the Background Art

Star pickets and other metal or wooden pickets with lengths that are typically 1800 mm or longer are commonly used to erect either permanent or temporary fences and barriers or to support temporary signs.

A star picket driver is designed to drive star pickets into the ground. A standard star picket driver is effectively a piece of pipe open one end only. It will usually have 2 handles so the operator can operate the device with both hands by lifting it up and pounding the star picket into the ground with downward force. The operator grips the handles, lifts the star picket driver and then with force drives it downwards, causing the closed end of the star picket driver to impact on the end of the star picket, which in turn pushes the star picket into the ground.

For the installation of the star picket, force must be applied to the top of the picket to drive it in to the ground. This force is typically achieved with a sledge hammer or lump hammer or using a star picket driver that is open at one end and closed at the other end. Using a hammer in one hand and holding the star picket with the other hand has inherent dangers if the operator misses the end of the star picket and strikes their hand with a hammer. Alternately the use of the standard star picket driver that is open at one end and closed the other end is usually quite heavy and can be difficult to lift to the required height to place it over the top of the star picket before the picket can be driven in to the ground, and even more difficult to lift off the star picket once it is driven in to the required depth.

A standard star picket driver is designed to slip over the top of a star picket, which can be an awkward process as the operator has to hold the picket driver in one hand and the star picket in the other and guide the picket into the bottom of the driver. This maneuver requires the operator to hold either the driver or the picket away from his body to get the picket into the hole in the bottom of the driver. Usually, the operator will raise the driver with one hand at an angle around shoulder height and then guide the star picket into the bottom of the driver with the other hand. Considering that a star picket is 1800 mm long on average and the picket drivers are 800 mm long, it can be difficult for those who aren't so tall or strong in the arms.

Often when fences are being installed, several hundred star pickets need to be driven in a day therefore as the day progresses the star picket driver becomes heavier as the operator becomes more fatigued. Although star pickets can also be driven into the ground with mechanical devices or heavy machinery there are a lot of locations or applications where these devices are either not available or impractical to use.

Another problem with the existing star picket drivers is that once the star picket has been driven in the ground the star picket driver needs to be lifted off the top of the star picket. The star pickets commonly stand 1200 mm high once they have been driven in. Lifting a picket driver up and over the top of each picket becomes very tiresome over the course of a day and can cause injury especially to the shoulders.

Throughout the specification the term "star picket" includes, fence posts, T posts, Y posts, star posts and timber pickets or stakes.

The main object of this invention is to provide the operator with a safe method of driving star picket into the ground and reducing fatigue and injury caused by the need to lift the standard star picket driver above the operator's head to remove it from the picket once it is driven in to the required depth.

It also assists operators of shorter stature because there are occasions where the operator is simply not tall enough to lift the star picket driver over the top of the star picket.

SUMMARY

The side load picket driver is loaded from the side instead of from the bottom. The side load star picket driver is closed at the top end and open at the bottom end and has a slot down the full-length on one side of the star picket driver so that the star picket can be loaded from the side instead of the open end. There are two handles, welded to each side of the star picket driver for the operator to grip the driver and pound the star picket into the ground.

An example driver is a hollow pipe or tube like device about 800 mm long incorporating the following:

- a body having one open end and the other end closed;
- the closed end of the device has a hammer plate welded in place to give the driver more weight and strength in an area that takes a lot of force;
- The body has a slot extending all the way from the open end, up to the hammer plate. The slot is curved inwards in such a way that allows a star picket to be inserted through the slot;
- Once the star picket is laid into the slot, the operator twists the star picket 180 degrees locking it into the star picket driver. Then once the picket is driven into the ground, the operator then turns the star picket driver 180 degrees to remove it from the picket, no lifting is needed in this procedure; and
- the star picket driver has one handle welded on each side for the operator to grip with both hands.

The example device has no moving parts and weighs about 6 kg.

The device is held in one hand and the star picket is held in the other hand, then laying the picket into the slot and twisting the picket 180° in clockwise direction locates the star picket into position within the device. This can be done at waist height without the necessity of lifting the assembly 2 metres or more into the air.

The bottom end of the star picket is then placed into the position desired on the ground, the whole assembly is set into its vertical position and the star picket is driven into the ground by lifting the device up and pounding it downwards onto the top of the star picket, thus driving it into the ground.

The operator pounds the star picket driver up and down without turning the device. This makes the device easy to use and ensures that the operator's hands are not in harms way.

The side load star picket driver is designed so that once the star picket has been driven into the ground, there is no need to lift the picket driver up and over the picket, the operator simply turns the picket driver 180 degrees and pulls the picket driver directly away from the star picket. This is where the slot in the side of the picket driver really comes into play and eliminates the need to lift the side load star picket driver upward, with arms above shoulder height, eliminating potential shoulder injury.

When the star picket has been driven into the ground sufficiently the driver is twisted 180° in the anti clockwise direction which will unlock the device from star picket and release it.

BRIEF DESCRIPTION OF THE DRAWINGS

An example embodiment of the invention is described with reference to the accompanying drawings in which the dimensional values are in units of millimeters and.

DETAILED DESCRIPTION

Figure 1:
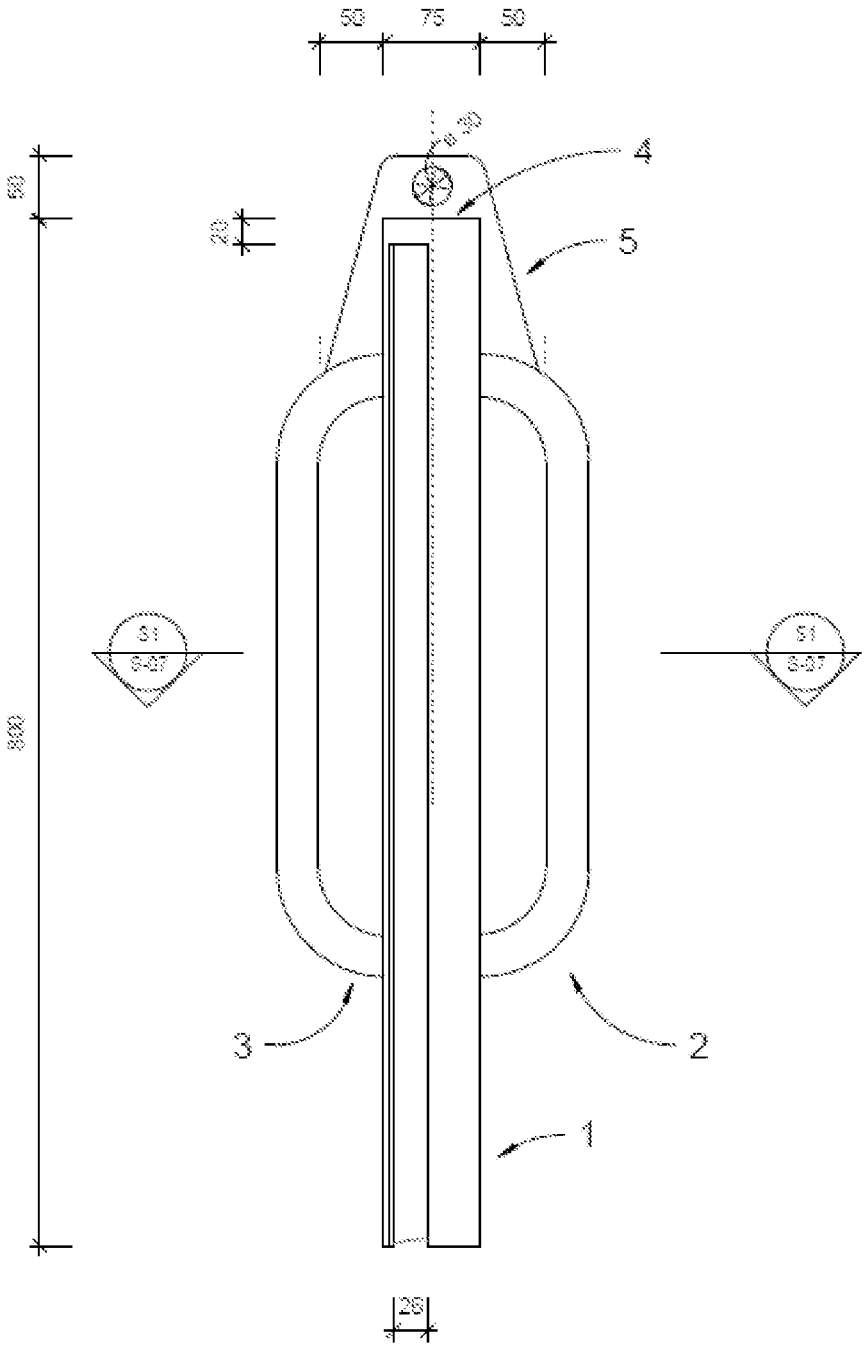
FIG. 1 is the front view of the star picket driver showing, the hole in the top of the driver as a utility hole to hang the device in a storage area when not in use, the body of the driver showing the slot cut in to the side of the body to load the star picket, and the two handles placed either side of the body.

Elements of the invention are illustrated in schematic outline form, in the drawings, showing only those specific details that are necessary to understand the embodiment of the invention, but so as not to obscure the disclosure with excessive detail that will be readily apparent to anyone who is skilled in this particular field of technology.

In this patent specification, adjectives such as front, back, top, right, etc, are used solely to define one element from another element without necessarily requiring a specific relative position or sequence that is described by the adjectives. Words such as "comprises" or "includes" are not used to define an exclusive set of elements. Rather, such words merely define a minimum set of elements included in a particular embodiment of the present invention.

Figure 2:
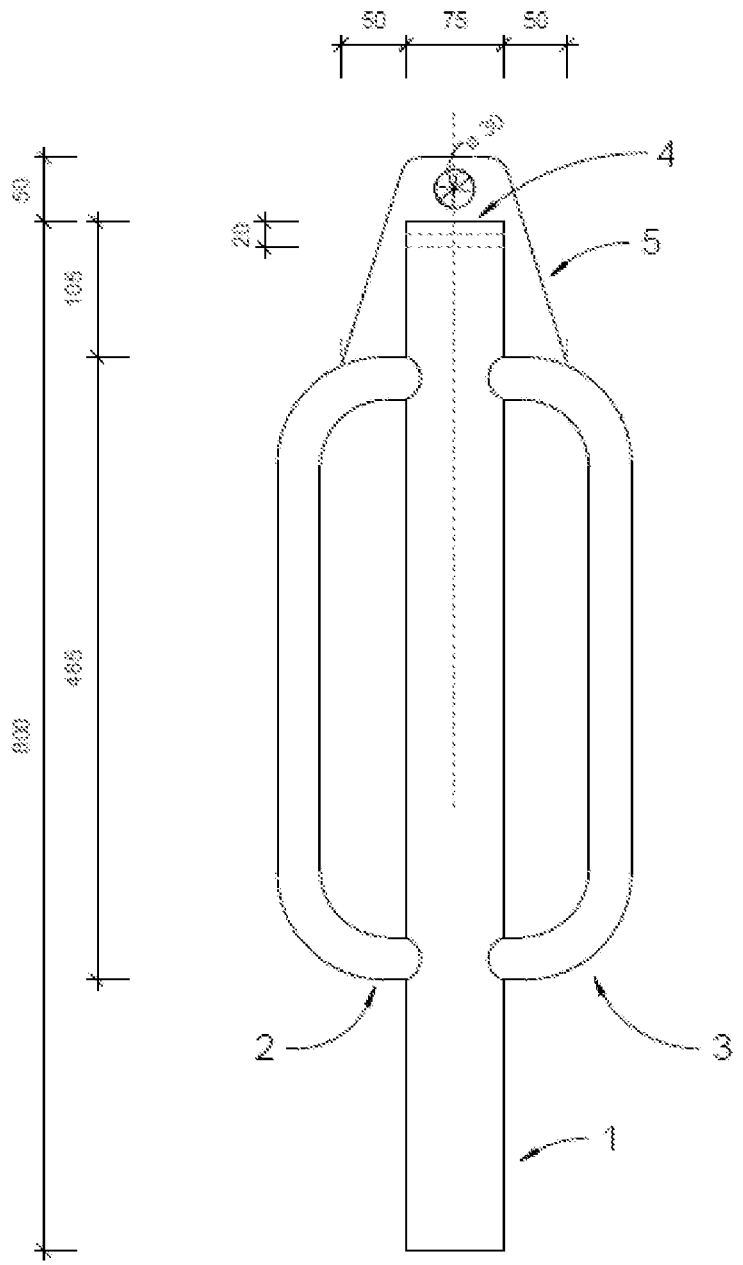
FIG. 2 is the back view of the star picket driver showing, the hole in the top of the driver as a utility hole to hang the device in a storage area when not in use, the body of the driver, and the two handles placed either side of the body.

FIG. 1 and FIG. 2 show the body of the side load star picket driver 1 from the front and from the back and show the positioning of the handles 2 and 3 for the operator to hold on to and show the positioning of the utility plate with a hole drilled therein 5 at the top of the unit for storage, and show the slot cut in the pipe for loading and unloading the star picket. FIG. 2 also shows a hammer plate or striker in phantom lines inside of picket driver 1 near the top of the unit 4. The bottom surface of the striker is a striking surface that impacts the top of pickets being driven into the ground.

Figure 3:
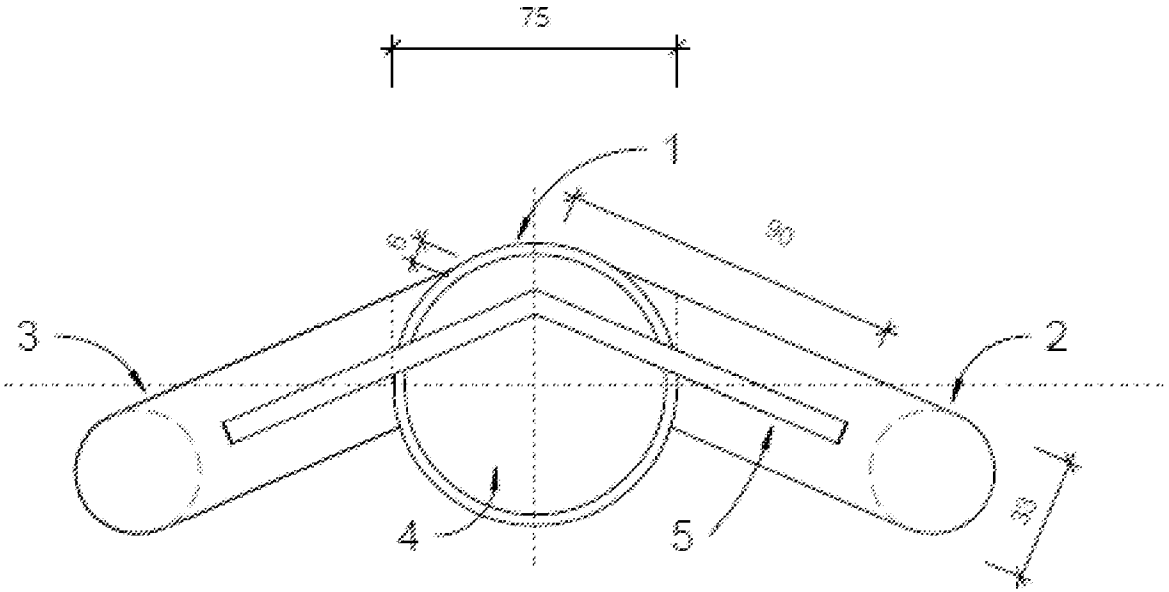
FIG. 3 is the top view of the star picket driver showing, the plate at the top of the driver where the utility hole is situated, the body of the star picket driver and the positioning of the 2 handles welded to the side of the body.

FIG. 3 shows the top view of the side load star picket driver and depict the hammer plate at the top of the unit 4 the utility plate 5 and the handles 2 and 3 for the operator to grip the invention.

Figure 4:
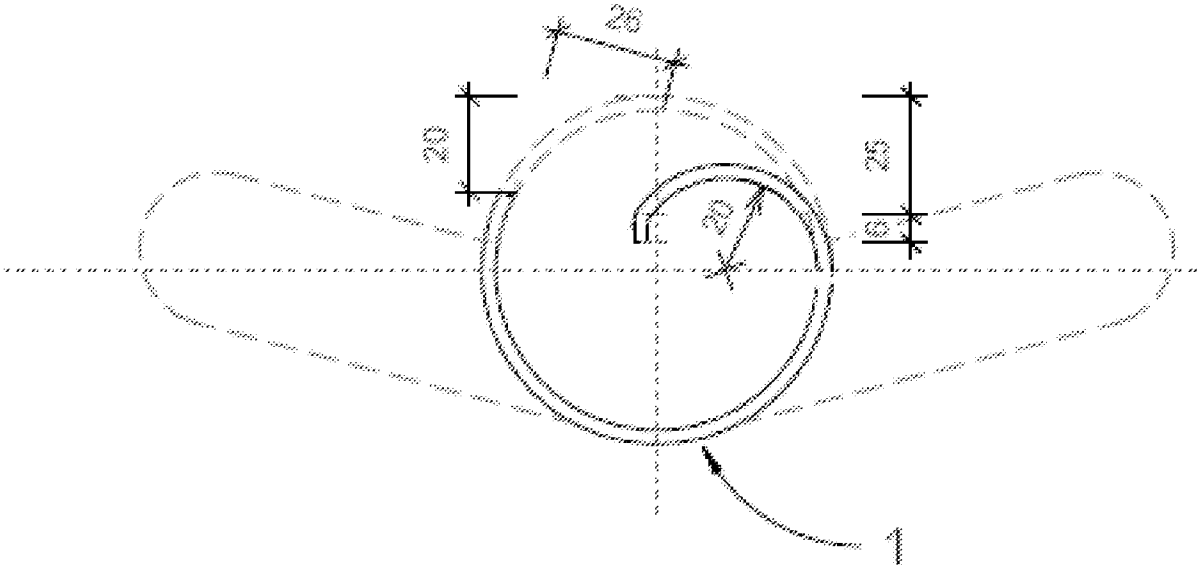
FIG. 4 is the bottom view of the star picket driver showing, the shape of the slot cut into the side of the driver to enable loading and unloading of the star picket.

FIG. 4 shows the bottom view of the side load star picket driver with details of the slot cut into the body 1 and the unique shape of the body 1 which allows the star picket driver to be loaded and unloaded.

Figure 5:
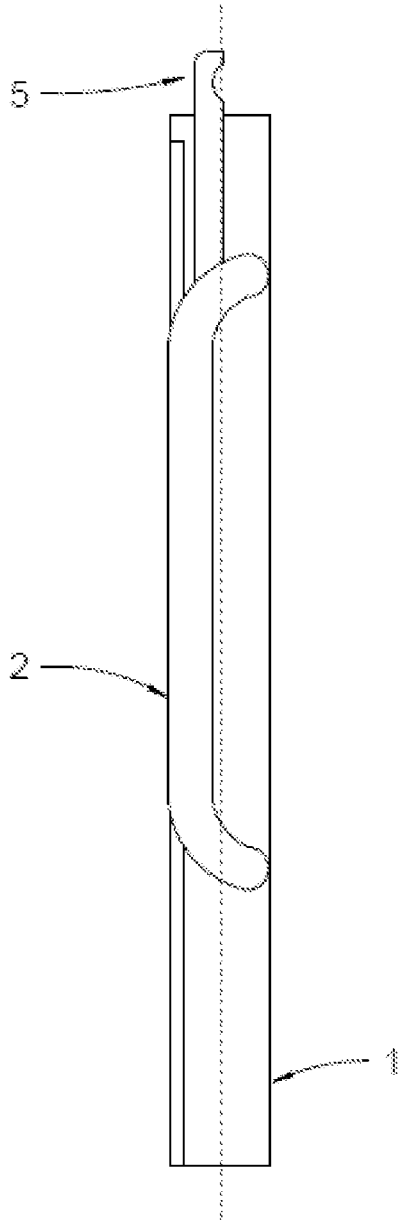
FIG. 5 is the right view of the star picket driver showing the right-hand handle, the body of the driver and the utility hole with assembly at the top of the driver.
Figure 6:
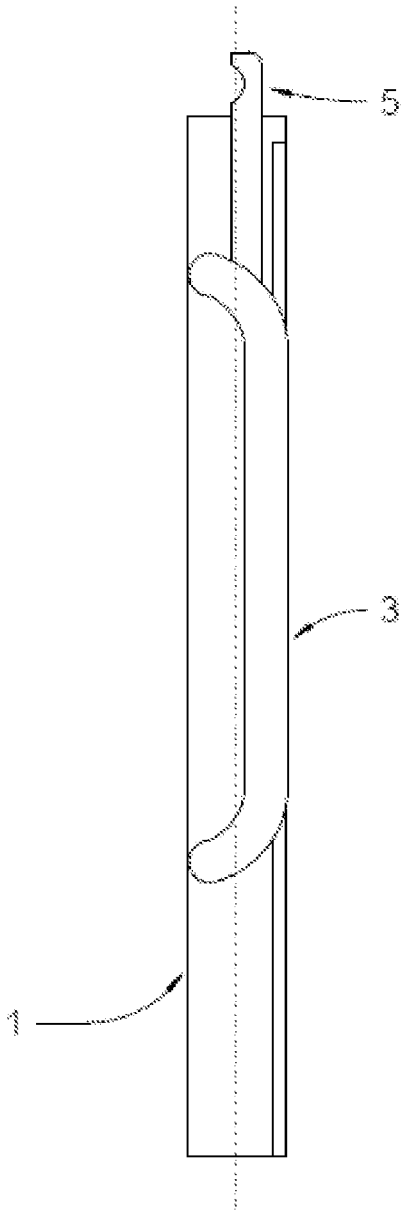
FIG. 6 is the left view of the star picket driver showing the left-hand handle, the body of the driver and the utility hole with assembly at the top of the driver.

FIG. 5 and FIG. 6 show the right and left views of the side load star picket driver respectively and show the positioning of the utility plate 5 and the handles 2 and 3 on the body 1.

Figure 7:
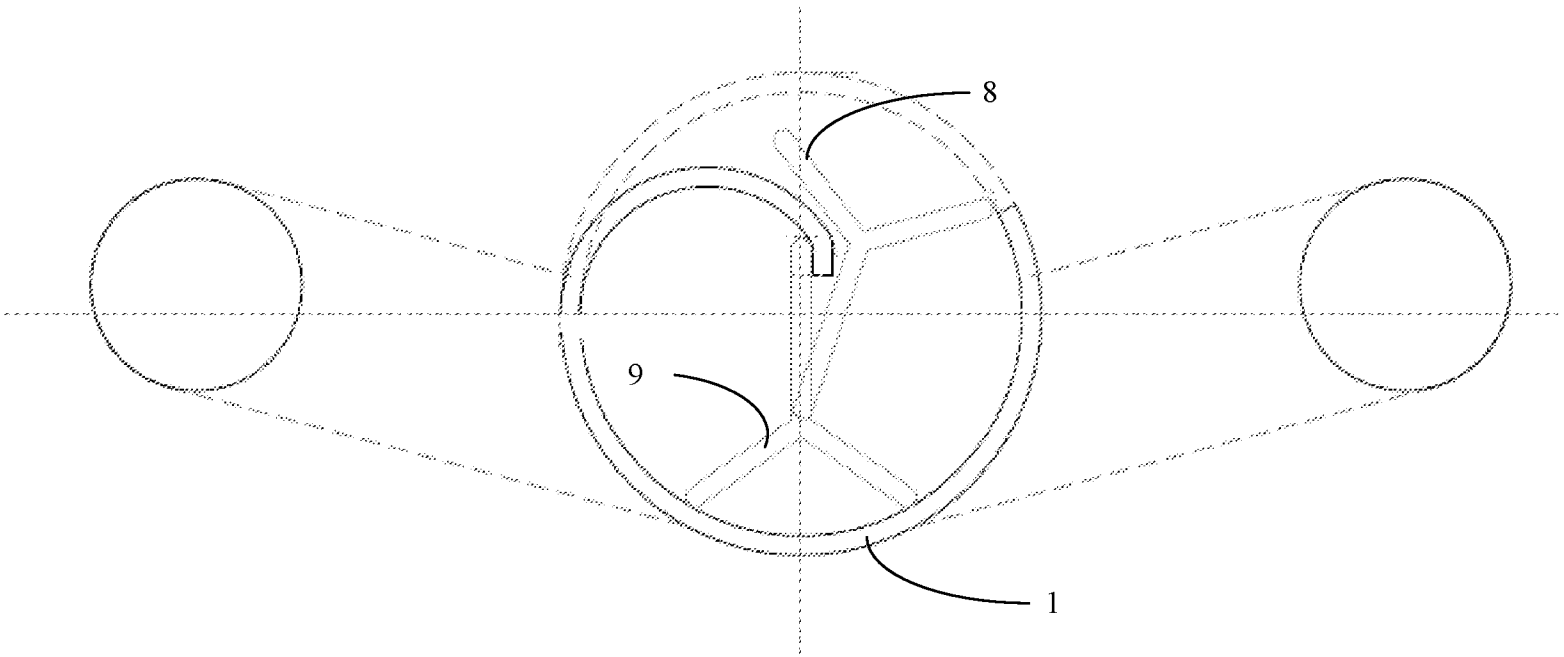
FIG. 7 is the section view of the star picket driver showing the loading and positioning of the star picket into the device.

FIG. 7 is the section view of the star picket driver 1 showing the loading and positioning of a star picket into the device. The star picket is shown in a first position 8 entering the side opening of the picket driver 1, and a second position 9 within the picket driver 1.

All of the star picket drivers presently available on the market of the tubular body type, load from the bottom of the star picket driver. The side load picket driver is loaded from the side. The advantages of this novel and inventive function would be obvious to a skilled person familiar with the art, in view of this disclosure.

With the side load picket driver, the picket driver is held in one hand, closer to the body, and the star picket is simply layed into the slot on the side of the driver. Once the picket has been layed into the slot, the operator need only twist the picket 180 degrees and it becomes locked into the side load star picket driver due to the specially designed shape of the tube. The side load star picket driver and picket can then be stood in position and the picket can be driven into the ground. The ergonomic design of the side load star picket driver allows anyone to load and use the driver without the strain on the arms and shoulders. The action of loading the picket into a side load star picket driver is not only easier but it is also quicker due to it being less difficult.

The whole unit is made from metal to give it strength and weight. A plastic material would not suffice as the star picket would split the plastic in a short period of time as well as plastic been too light to offer the inertia created by the weight necessary to drive the picket into hard ground. The handles are of sufficient length to be suitable for operators of different heights to be comfortable when operating the device and the handles are offset to allow for greater comfort and thus reducing body stresses.

The advantages become more apparent, in view of this disclosure, to a person familiar in the art when you consider that some people are shorter than others and maybe not as strong. The awkward loading procedure of a standard picket driver and especially the removal of the driver from the picket once it is driven into the ground is eliminated with the use of the side load star picket driver. People familiar with using a picket driver will see the safety benefit of the side load star picket driver by not having to lift the driver off the top of the picket, drastically reducing stress on the shoulder joint and reducing the overall strain of using a picket driver.

The advantages of the present invention over a standard star picket driver include, but are not limited to, the robustness of the invention is heavy and thus will offer long life, by being able to withstand repeated strikes to the star picket's and eliminate the necessity for operators to lift the star picket driver above their head to remove the star picket driver from the picket once it is driven into the ground. This reduces stretching and reduces the possibility of the operator dropping the star picket driver on themselves and injuring themselves either by impact with the falling tool or by stretching or damaging muscles and particularly shoulder joints, as well as reducing the stresses on the body for repeated usages of the invention, often in excess of 200 star pickets per day.

The enclosed description of various embodiments of the present invention is provided for the purposes of description to one of ordinary skill in the related field of technology. It is not intended to be exhaustive or limit the invention to a single disclosed embodiment.

I claim:

1. A picket driver comprising:

a striker including a striking surface configured to strike a picket;

a sidewall extending away from said striker along an axis passing through said striking surface, said sidewall having a top edge coupled to said striker, a bottom edge opposite said top edge, a first side edge, a second side edge opposite said first side edge, an exterior surface, and an interior surface, said interior surface at least partially defining a picket receiving space below said striker, said sidewall defining an opening into said interior space, said opening disposed between a portion of said interior surface adjacent said first side edge and a portion of said exterior surface adjacent said second side edge, said portion of said exterior surface adjacent said second side edge facing said portion of said interior surface adjacent said first side edge, said opening extending upwardly from said bottom edge of said sidewall; and a first handle fixed with respect to said sidewall.

2. The picket driver of claim 1, wherein said interior surface of said sidewall includes a first portion having a first radius of curvature and a second portion having a second radius of curvature that is less than said first radius of curvature.

3. The picket driver of claim 2, wherein:

said interior surface of said sidewall includes a third portion;

said third portion is planar; and said second portion is disposed between said first portion and said third portion.

4. The picket driver of claim 1, further comprising a second handle fixed with respect to said sidewall.

5. The picket driver of claim 4, wherein:

said first handle extends from said exterior surface of said sidewall on a first side of said picket driver; and said second handle extends from said exterior surface of said sidewall on a second side of said picket driver.

6. The picket driver of claim 5, wherein said opening is disposed between said first handle and said second handle.

7. The picket driver of claim 1, wherein:

said first side edge of said sidewall extends along a first linear path;

said second side edge of said sidewall extends along a second linear path; and said first linear path is parallel to said second linear path.

8. The picket driver of claim 7, wherein:

said striking surface is substantially planar;

said first linear path is perpendicular to said striking surface; and said second linear path is perpendicular to said striking surface.

9. The picket driver of claim 1, wherein said sidewall has a cross-sectional profile that is perpendicular to said axis; and said cross-sectional profile of said sidewall is constant along a said axis between a top margin of said opening and said bottom edge of said sidewall.

10. The picket driver of claim 9, wherein said cross-sectional profile of said sidewall includes a first portion having a first radius of curvature and a second portion having a second radius or curvature that is lesser than said first radius.

11. The picket driver of claim 10, wherein said cross-sectional profile of said sidewall includes a third portion;

said third portion is flat; and said second portion of said cross-sectional profile of said sidewall is disposed between said first portion of said cross-sectional profile of said sidewall and said third portion of said cross-sectional profile of said sidewall.

12. The picket driver of claim 1, wherein said picket driver is a metal rigid body structure.

13. A method for driving a picket into the ground, said method comprising:

providing a picket having a bottom end, a top end, and a cross-sectional profile, said cross-sectional profile having at least one leg extending outwardly from a longitudinal axis of said picket;

providing a picket driver including a striker including a striking surface configured to strike a picket, a sidewall extending away from said striker along an axis passing through said striking surface, said sidewall having a top edge coupled to said striker, a bottom edge opposite said top edge, a first side edge, a second side edge opposite said first side edge, an exterior surface, and an interior surface, said interior surface at least partially defining a picket receiving space below said striker, said sidewall defining an opening into said interior space, said opening disposed between a portion of said interior surface adjacent said first side edge and a portion of said exterior surface adjacent said second side edge, said portion of said exterior surface adjacent said second side edge facing said portion of said interior surface adjacent said first side edge, said opening extending upwardly from said bottom edge of said sidewall, and a first handle fixed with respect to said sidewall;

aligning said picket in said opening of said sidewall;

rotating one of said picket driver and said picket relative to the other of said picket and said picket driver in a first direction until said picket is disposed in said receiving space of said sidewall with said at least one leg disposed adjacent said interior surface of said second edge of said sidewall;

positioning said picket and said picket driver in an upright position with said bottom end of said picket on the ground;

repeatedly urging said striker away from said top portion of said picket and then impacting said top portion of said picket with said striker until a portion of said picket is driven into the ground; and rotating said picket driver relative to said picket in a second direction opposite said first direction to remove said picket from said picket receiving space of said sidewall through said opening.

14. The method of claim 13, wherein:

said picket includes a plurality of legs extending outwardly from said longitudinal axis of said picket; and said at least one leg of said picket is longer than a second leg of said picket.

15. The method of claim 13, wherein:

said sidewall has a cross-sectional profile that is perpendicular to said axis; and said cross-sectional profile of said sidewall is constant along said axis between a top margin of said opening of said sidewall and said bottom edge of said sidewall.

16. The method of claim 15, wherein said cross-sectional profile of said sidewall includes a first portion having a first radius of curvature and a second portion having a second radius of curvature that is less than said first radius of curvature.

17. The method of claim 16, wherein said cross-sectional profile of said sidewall includes a third portion;

said third portion is flat; and said second portion is disposed between said first portion and said third portion.

18. The method of claim 13, wherein:

said first side edge of said sidewall extends along a first linear path;

said second side edge of said sidewall extends along a second linear path; and said first linear path is parallel to said second linear path.

19. A picket installation system comprising:

a picket having a bottom end, a top end, and a cross-sectional profile perpendicular to a longitudinal axis of said picket, said cross-sectional profile having a plurality of legs extending outward from said longitudinal axis of said picket; and a picket driver including a striker including a striking surface configured to strike said top end of said picket, a sidewall extending away from said striker along an axis passing through said striking surface, said sidewall having a top edge coupled to said striker, bottom edge opposite said top edge, a first side edge, a second side edge opposite said first side edge, an exterior surface, and an interior surface, said interior surface at least partially defining a picket receiving space below said striker, said sidewall defining an opening into said interior space, said opening disposed between a portion of said interior surface adjacent said first side edge and a portion of said exterior surface adjacent said second side edge, said portion of said exterior surface adjacent said second side edge facing said portion of said interior surface adjacent said first side edge, said opening extending upwardly from said bottom edge of said sidewall, and a first handle fixed with respect to said sidewall.

20. The picket installation system of claim 19, wherein said interior surface of said sidewall includes a first portion having a first radius of curvature and a second portion having a second radius of curvature that is less than said first radius of curvature.

* * * * *